US007418918B2

(12) United States Patent
Bierbower et al.

(10) Patent No.: US 7,418,918 B2
(45) Date of Patent: Sep. 2, 2008

(54) FOLDABLE BOAT COVER

(75) Inventors: William Bierbower, 1580 Harvest La., Alpharetta, GA (US) 30004; Quentin Wayne Utz, Alpharetta, GA (US)

(73) Assignee: William Bierbower, Alpharetta, GA (US)

( * ) Notice: Subject to any disclaimer, the term of this patent is extended or adjusted under 35 U.S.C. 154(b) by 0 days.

(21) Appl. No.: 11/531,574

(22) Filed: Sep. 13, 2006

(65) Prior Publication Data

US 2008/0060570 A1 Mar. 13, 2008

(51) Int. Cl.
*B63B 17/02* (2006.01)

(52) U.S. Cl. ..... 114/361; 135/88.01

(58) Field of Classification Search ..... 114/361; 135/88.01, 90, 96

See application file for complete search history.

(56) References Cited

U.S. PATENT DOCUMENTS

| | | | | |
|---|---|---|---|---|
| 3,001,212 | A * | 9/1961 | Towne | 114/361 |
| 3,032,046 | A * | 5/1962 | Coonradt | 135/90 |
| 6,349,666 | B1 | 2/2002 | Hastings | |
| 6,439,150 | B1 * | 8/2002 | Murphy et al. | 114/361 |
| 6,584,926 | B1 * | 7/2003 | Schmitt et al. | 114/361 |
| 6,666,163 | B2 | 12/2003 | Pastor et al. | |
| 6,691,637 | B1 * | 2/2004 | Smith et al. | 114/361 |
| 6,725,799 | B2 | 4/2004 | Tull | |
| 6,799,529 | B1 | 10/2004 | Willis | |
| 7,216,604 | B2 * | 5/2007 | Finney et al. | 114/361 |
| 2003/0111101 | A1 | 6/2003 | Tull | |
| 2005/0194031 | A1 * | 9/2005 | Goldwitz | 135/128 |

OTHER PUBLICATIONS http://www.boattowers.com/CanvassTtop.htm, Feb. 15, 2005.
http://www.marinehardwarefabric.com/boat-t-tops.html, printed Feb. 27, 2006, date unknown.
http://www.atlantictowers.com/at_sub/products_s_t.html, printed Feb. 27, 2006, date unknown.
http://www.cesmithco.com/product/ttop.htm, copyright 2001.
Smith Stainless Steel Ttops and Boating Accessories, Installation Instructions for Model 52100 Stainless Steel Ttop Jun. 28, 2004.
Atlantic Towers Atlantic Standard T-top Install Instructions, printed May 31, 2005, date unknown.
T Seat, GG Schmitt & Sons Marine Hardware, date unknown.
Introducing T Seat, GG Schmitt & Sons Marine Hardware, date unknown.

* cited by examiner

*Primary Examiner*—Ed Swinehart
(74) *Attorney, Agent, or Firm*—Withers & Keys, LLC

(57) ABSTRACT

Foldable boat covers provide various features including a cover portion which is foldable. Other features include hinges allowing the base structure to be folded. By folding the cover portion, the base structure, or both the cover portion and base structure, the boat may be placed in a garage or on a covered boat lift with a lesser likelihood of the boat cover interfering.

18 Claims, 19 Drawing Sheets

FOLDABLE BOAT COVER

TECHNICAL FIELD

Embodiments relate to foldable boat covers installed on boats for providing protection from the elements, for example sun and rain, and to provide a place to stow or mount equipment for fishing and general boating activities.

BACKGROUND

Boat covers allow enthusiasts to be protected from the elements and also to stow equipment as well as provide a place to mount antennas, rod holders, etc. for a boat that the boat cover is mounted on. Simple boat covers are essentially a generally flat cover supported by four legs which are attached to the boat.

Boat covers provide shelter and protection for passengers on the boat as well as for the boat itself including electronics and other equipment. Various styles and configurations of boat covers are commonly known in the prior art. One conventional boat cover is a tee-top ("T-top"), which consists of a framework attached to the center console and/or decks of the boat. Conventional boat cover assemblies comprise a boat cover that is permanently and inflexibly secured such that, once installed, the cover's position and orientation never change, other than to be partially or completely removed from the boat.

A further problem with custom-made boat covers is that they maintain a fixed position. As a result of this fixed positioning, the boat must be stored in a special housing that has ample room for the added height of the fixed boat cover. More specifically, a boat having a custom built boat cover usually cannot be stored in a standard size garage or a commercial covered marine storage facility because of the standard height of the boat cover.

SUMMARY

Illustrative embodiments address these issues and others by providing boat covers that include various features absent in earlier boat covers. Features of some embodiments provide for a device that can be folded down in one or more ways to allow an overhead lift to be used, as well as storage in home garages and typical boat storage facilities.

One embodiment of a boat cover includes a cover portion including a plurality of attachment points and at least one hinge. The cover portion has a front portion, a back portion, a first side portion and a second side portion. A first leg includes a distal end and a proximal end, wherein the distal end provides a boat attachment point and the proximal end provides a cover attachment point. A second leg includes a distal end and a proximal end, the distal end provides a boat attachment point and the proximal end provides a cover attachment point. A third leg includes a distal end and a proximal end, the third leg linked to the cover portion. A fourth leg including a distal end and a proximal end, and the fourth leg is linked to the cover portion. The cover portion has a first position in which the cover portion is extended and a second position in which the cover portion is folded about the at least one hinge.

Another embodiment is a boat cover that includes a cover portion including at least one hinge such that the cover portion has at least two positions, an extended position and a folded position. The cover portion is supported by at least one of a plurality of legs. In an exemplary embodiment, the cover portion comprises a front portion, a first side portion, a second side portion and a back portion.

Another embodiment is a method of folding a boat cover that has two front legs, two rear legs and a cover portion and that is mounted to a boat. The method comprises rotating an upper section of each of the two front legs relative to a lower section of each of the two front legs until a front portion of the cover portion comes to rest in a reclined position. The method also comprises rotating a back portion of the cover either toward the bow or aft of the boat until the back portion comes to rest in a reclined position.

Another embodiment is a method of packaging components of a boat cover including a cover portion, a plurality of legs and a screen. The method involves positioning the plurality of legs side by side. The method further involves positioning the plurality of members comprising the cover portion side by side in a stacked configuration next to the plurality of legs.

DETAILED DESCRIPTION

Illustrative embodiments include boat covers and associated methods of folding boat covers from an upright state to a folded state. Features of certain embodiments provide for compact packaging to transport the boat cover.

As noted above, such boat covers may be used to stow or mount equipment such as electronics including, for example, graphs and radios, as well as for providing protection from the elements such as protecting persons, and equipment, from the sun and rain. However, it will be appreciated that stowing and mounting objects on a boat cover presents additional dangers to persons and equipment and also poses a greater risk of damage to the boat upon which the device is mounted.

Figure 1:
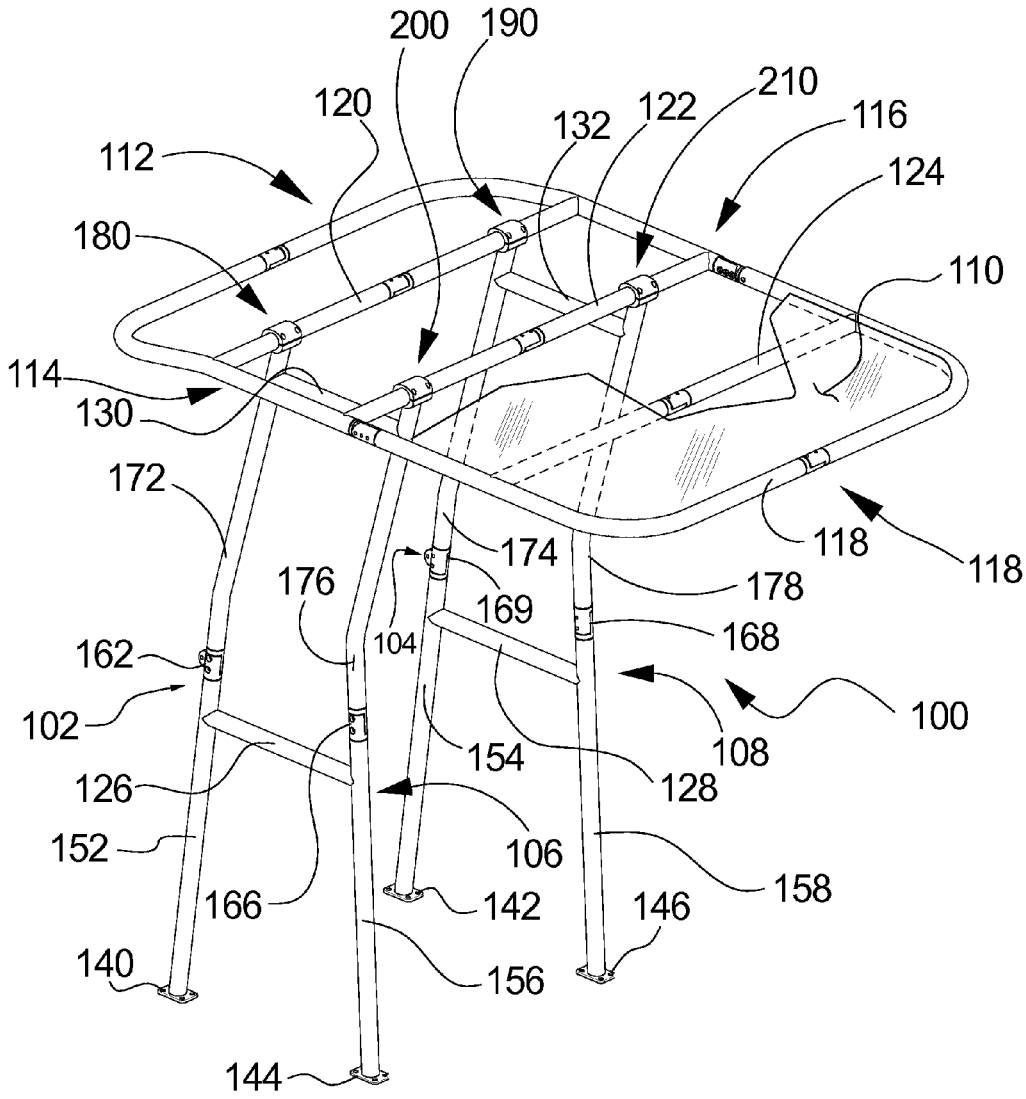
FIG. 1 is a perspective view of an embodiment in an upright state.
Figure 2:
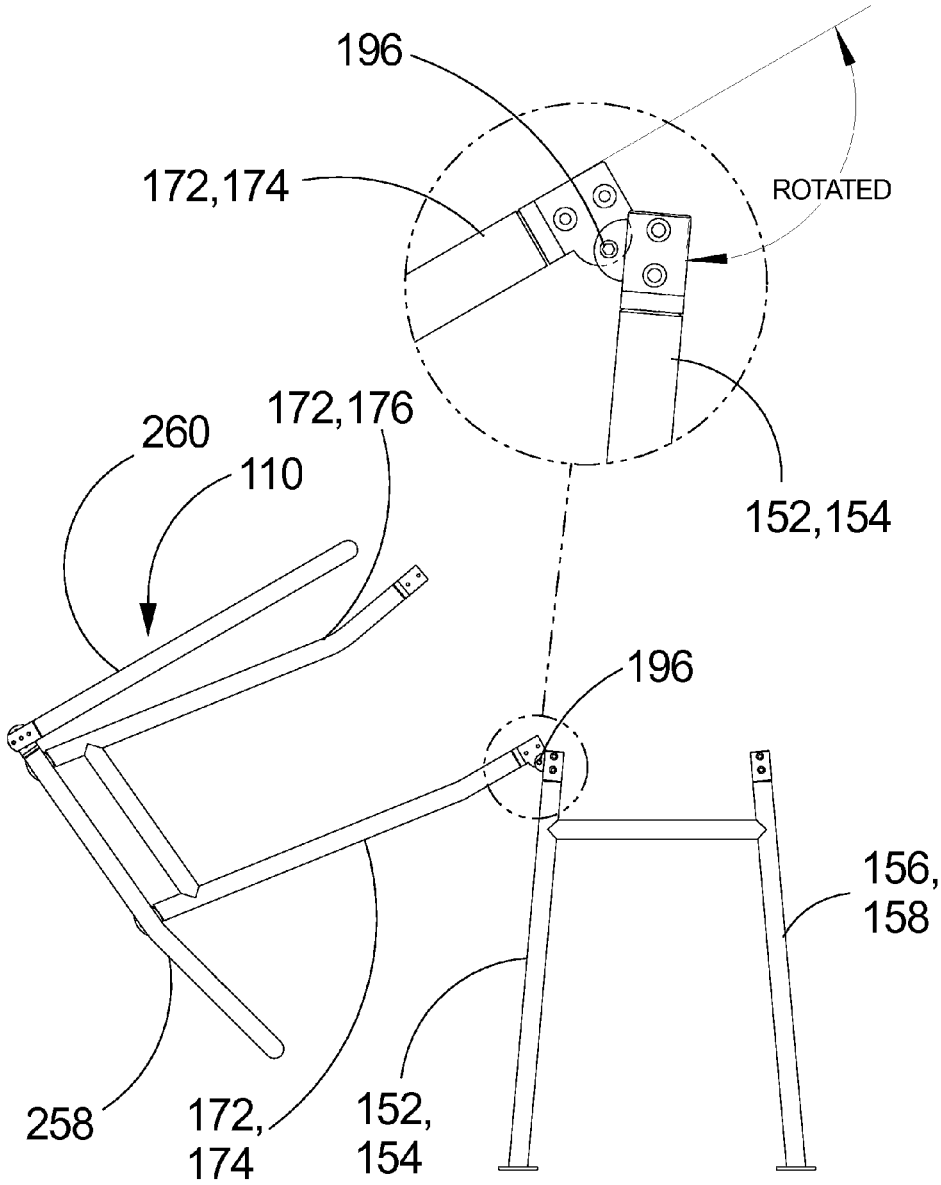
FIG. 2 is a side view of the embodiment of FIG. 1 in a folded state showing an exemplary joint in a pivoted condition.
Figure 3:
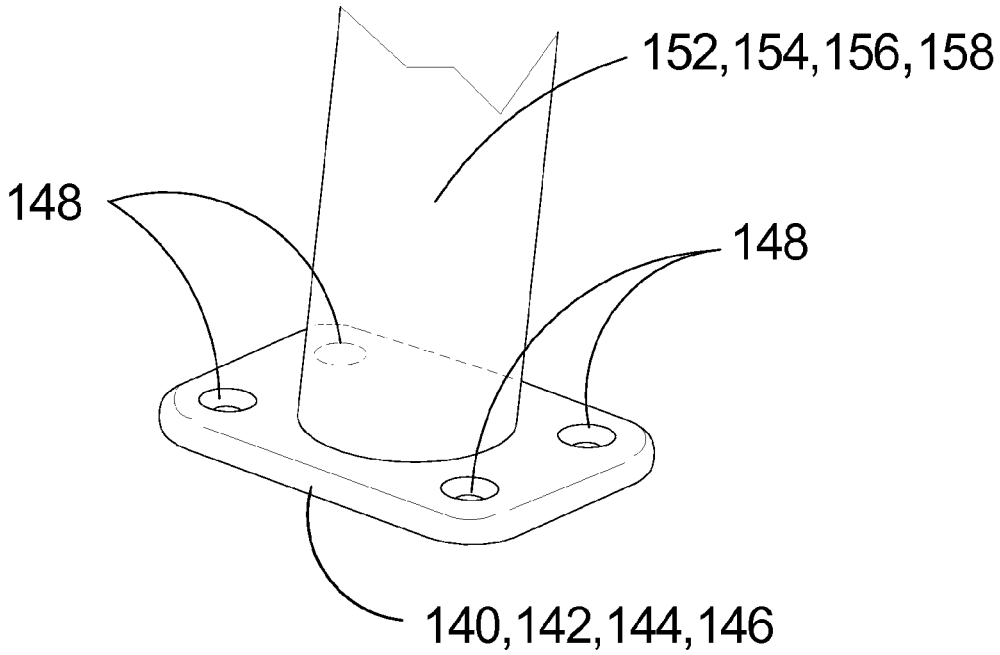
FIG. 3 is an enlarged view of the base member of the embodiment of FIGS. 1-2.

FIGS. 1-14 show various views of an illustrative embodiment 100 of a boat cover. Boat cover 100 of this particular embodiment includes two front legs 102, 104, two rear legs 106, 108 and cover portion 110. As illustrated in FIGS. 1-2, the front legs 102, 104 of this embodiment are shown to be generally straight while the rear legs are curved or bent. However, it will be appreciated that the various legs may be straight, curved or bent in one or more planes.

Figure 7:
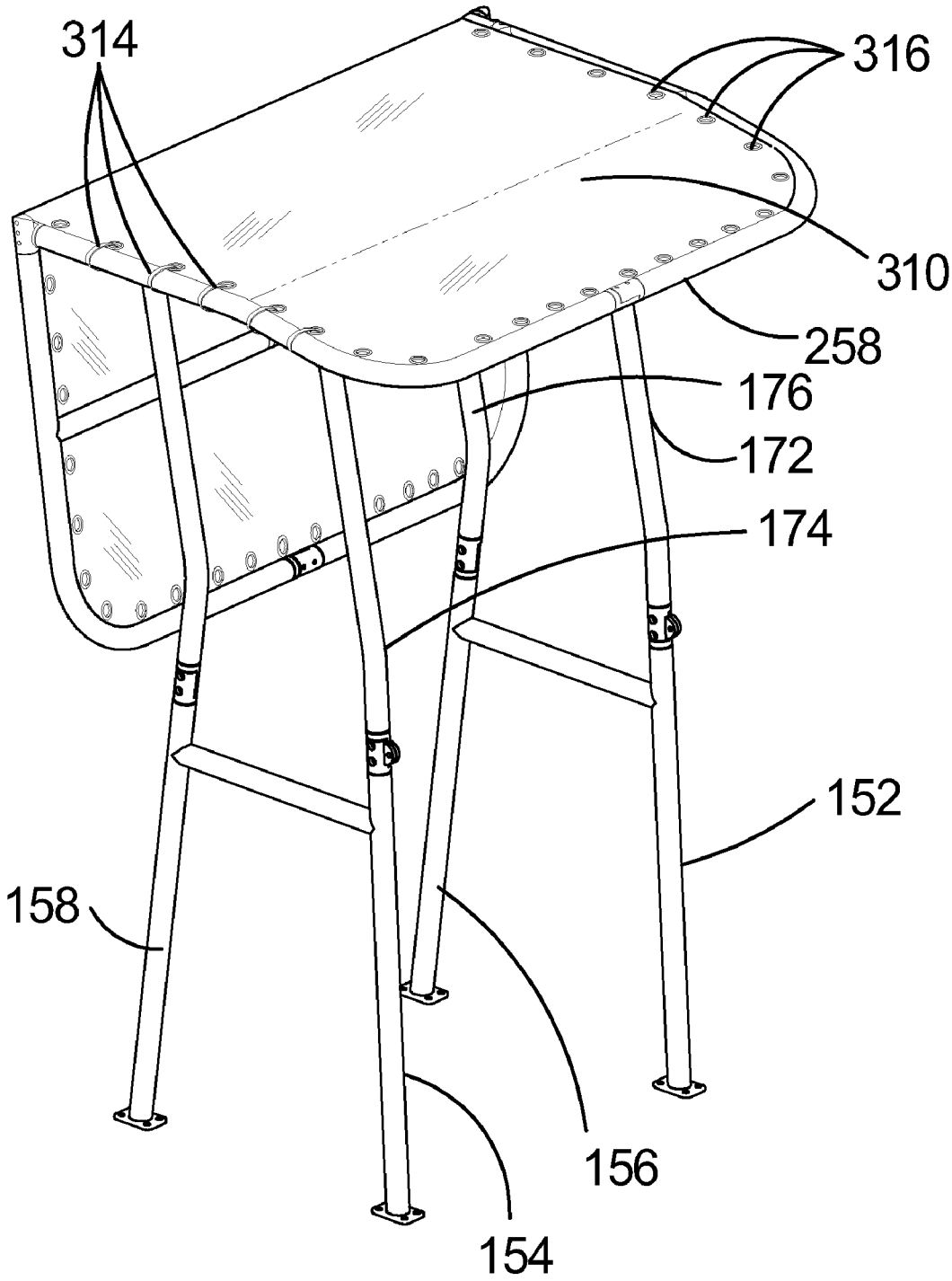
FIG. 7 is a side view of the embodiment of FIG. 1 in a transition state between the upright state of FIG. 1 and the folded state of FIG. 2.
Figure 14:
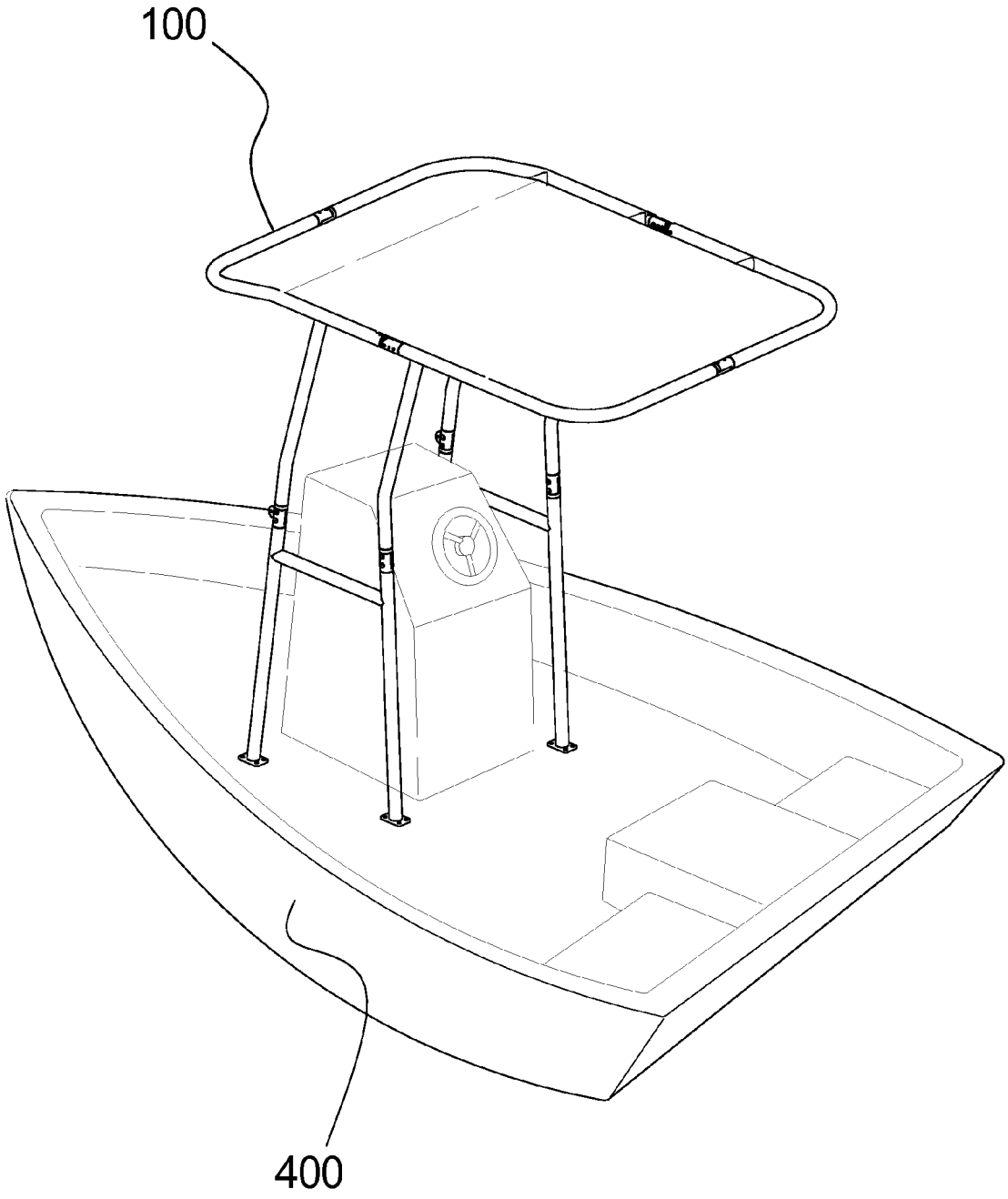
FIG. 14 is a perspective view of an embodiment in an upright state and mounted to a boat.

FIGS. 1 and 14 illustrate an exemplary embodiment of boat cover 100 in an upright state, the boat cover 100 being mounted to a boat 400 in FIG. 14, whereas FIG. 2 illustrates boat cover 100 in a folded state. FIG. 7 illustrates boat cover 100 in a transition position between the upright position of FIG. 1 and the folded position of FIG. 2 and further illustrating an optional screen 310.

Generally, the illustrated embodiment consists of a base structure including plurality of legs 102, 104, 106, 108 and a cover portion 110.

I. Boat Cover Components

Boat covers may comprise one or more of the following components.

A. Base Structure

Various embodiments of boat covers may comprise a base structure and a cover portion. The base structure comprises one or more legs which support cover portion 110. The base structure may also comprise one or more attachment means for securing the legs to a boat floor and center console and it may include one or more clamps which may be used to secure the legs to the cover portion at respective attachment points. FIGS. 1-2 illustrate an exemplary boat cover in which the base structure includes two front legs 102, 104, two rear legs 106, 108, base members 140, 142, 144, 146, and clamps 180, 190, 200, 210.

As illustrated in the exemplary embodiment of FIG. 1, legs 102, 104, 106, 108 include respective base members 140, 142, 144, 146, at distal ends of the legs in order to mount the base structure to a boat or other structure for which a suitable cover may be useful including, but not limited to, all terrain vehicles, pontoons, rigid inflatables, and docks. Each base member 140, 142, 144, 146, includes a plurality of mounting holes 148 (shown in more detail in FIG. 3) through which a plurality of mounting bolts or screws (not shown) extend in order to secure the legs to the boat deck (marine adhesive may also be used). Note that the various screws or bolts of the present embodiment may each include a knob that enables a user to loosen and tighten the bolt by hand to make releasing the legs and the cover portion from the boat a quick and easy task. Also note that although illustrated using bolts and mounting plates to fixedly attach the legs to the boat, various means including, but not limited to, hinge, swivel, and slidable connections are suitable as well for embodiments where it is desirable for the legs to pivot or rotate, such as may be desired in order for the legs to be able to relieve stress or in order to make the structure adaptable to fit various boat geometries. It will also be appreciated that in some embodiments, the legs may be fixed by other means than bolts and mounting plates, such as, for example, by gluing, bonding or welding.

As discussed above and illustrated in FIGS. 2 and 7, the base structure may be foldable. In particular, FIG. 2 illustrates that the various legs 102, 104, 106, 108 may comprise multiple segments. For example, front leg 102 may comprise a lower section 152, a hinge 162 and an upper section 172. Likewise front leg 104 may comprise a lower section 154, a hinge 164 and an upper section 174. Similarly, rear leg 106 may comprise respective lower section 156, joint 166 and upper section 176 and rear leg 108 may comprise respective lower section 158, joint 168 and upper section 178.

Figure 4:
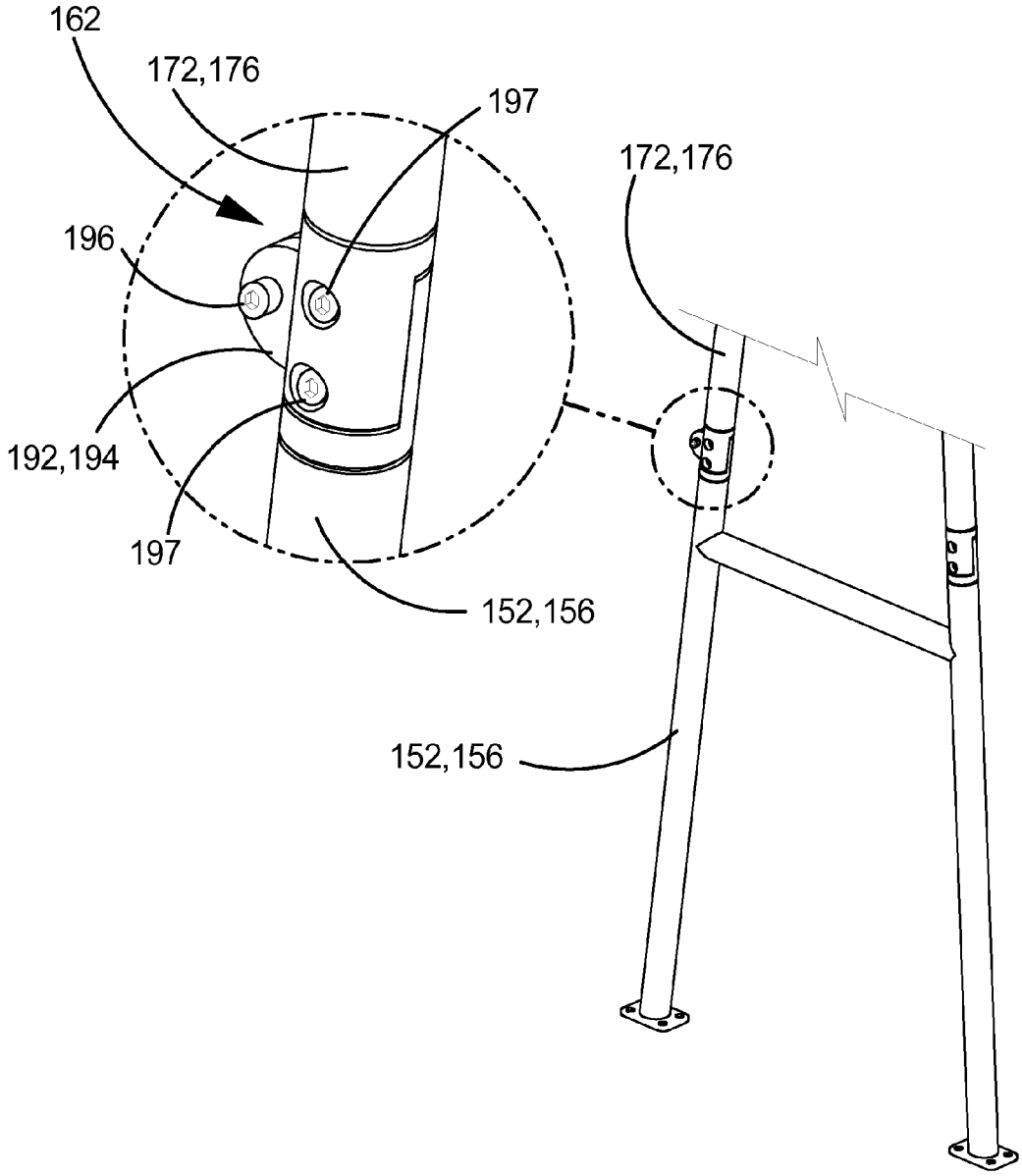
FIG. 4 is a perspective view of an exemplary joint between upper and lower sections of front legs of the embodiment such as the joint of FIG. 2.
Figure 13:
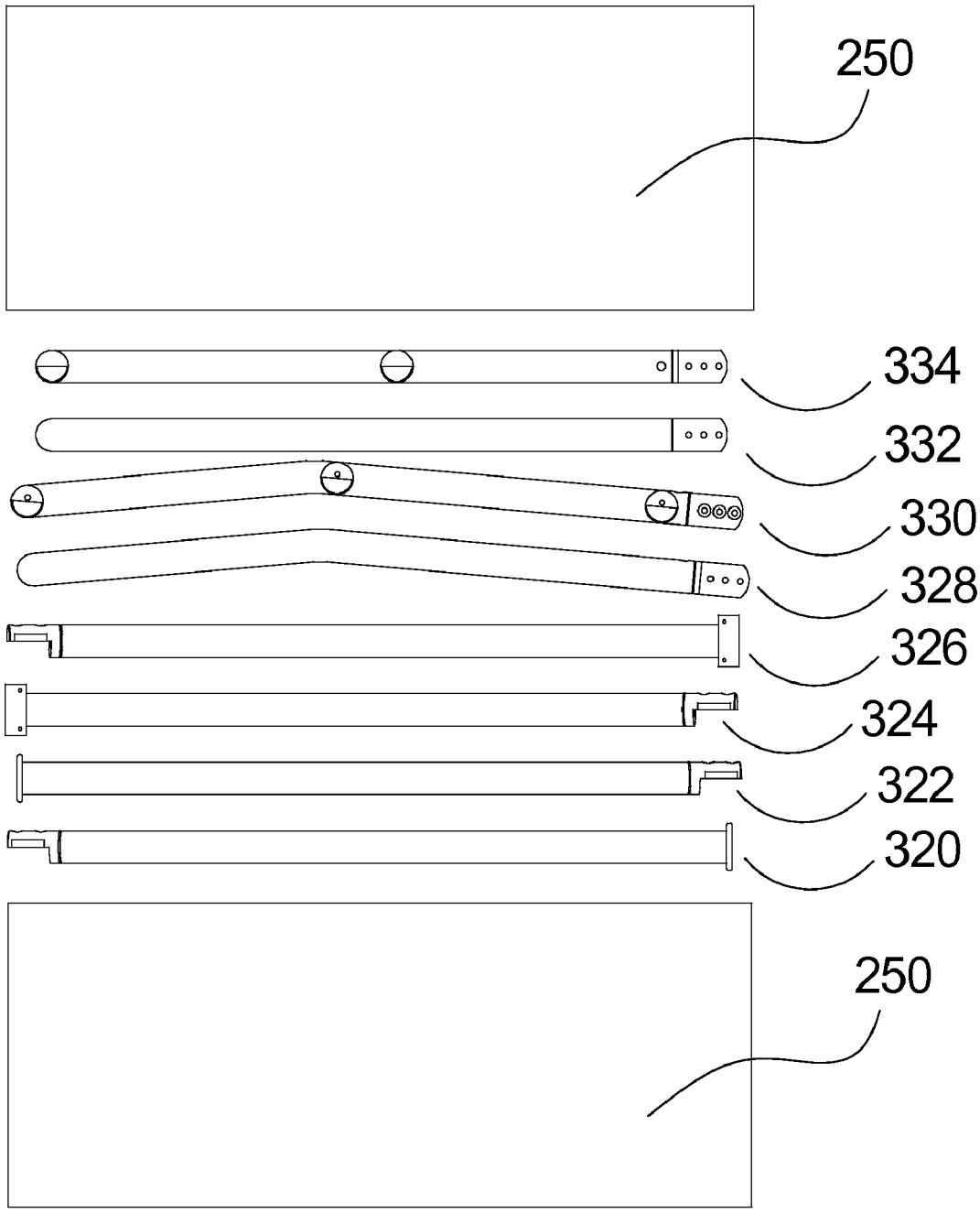
FIG. 13 is a side view of the various members of FIG. 12 arranged for packaging.

FIG. 4 in conjunction with FIG. 2 illustrates a perspective view and side/cross-sectional view, respectively, of a representative hinge 162 which may be utilized between leg 102's lower section 152 and upper section 172. It will be appreciated that various hinges and other means may be utilized to connect the various leg sections and that hinge 162 is illustrative only. The exemplary embodiment of FIG. 4 include a lower flange 192 extending from lower section 152, an upper flange 194 extending from upper section 172 and a bolt 196 extending between the flanges 192, 194. Bolt 196 allows upper flange 194/upper section 172 to be pivoted about lower flange 192/lower section 152. In this embodiment, offsetting bolt 196 allows upper section 172 to be pivoted from a position in which it is in line with lower section 152 (i.e., where the angle between the sections is approximately 0 degrees) to a position in which upper section 172 is almost parallel to lower section 152 (i.e., where the angle between the sections is about 180 degrees). FIG. 4 also illustrates that there may be additional bolts 197 which may extend between lower section 152 and upper section 172 such that when bolts 197 extend between sections 152, 172, the sections 152, 172 are locked in position such that they may not pivot about hinge 162. When bolts 197 are removed as illustrated in FIG. 2, upper section 172 may be pivoted about hinge 162 relative to lower section 152 (reference number 199 indicates the slots where the bolts were removed). If both bolts 197 and bolt 196 are removed, upper section 172 may be separated from lower section 152 as illustrated in FIG. 13. A similar joint 168 with another bolt 160 may connect similar flanges of rear leg 108's lower section 158 and upper section 178. Note that although two bolts 197 are illustrated in FIG. 4, any number of bolts, or even no bolts 197, may be used in a particular embodiment.

Figure 5A:
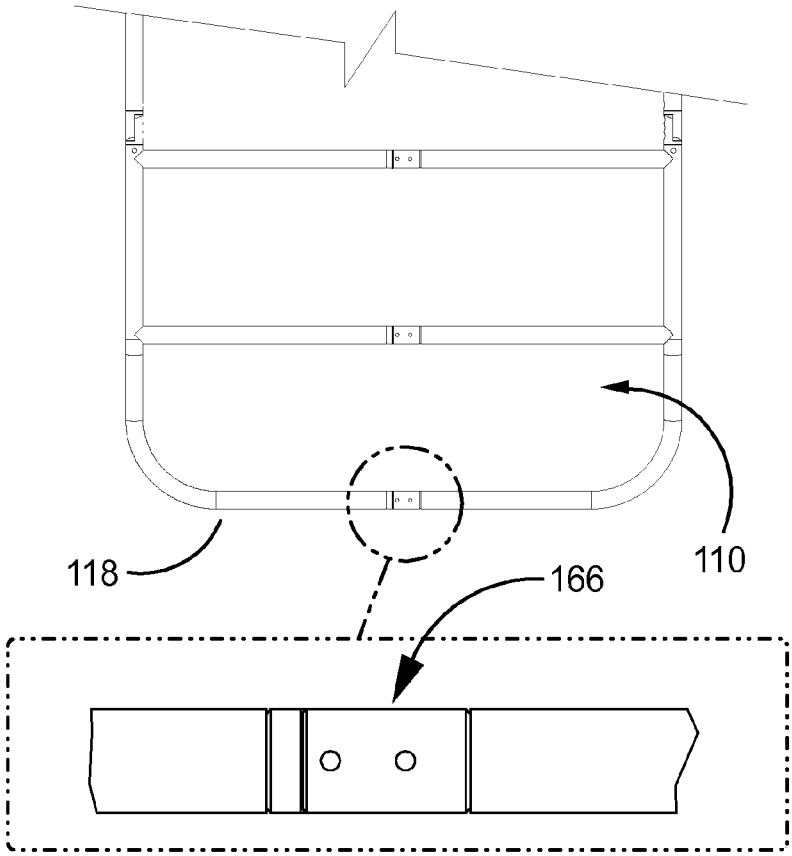
FIG. 5A is a side view of an exemplary joint between select members of an exemplary embodiment.
Figure 5B:
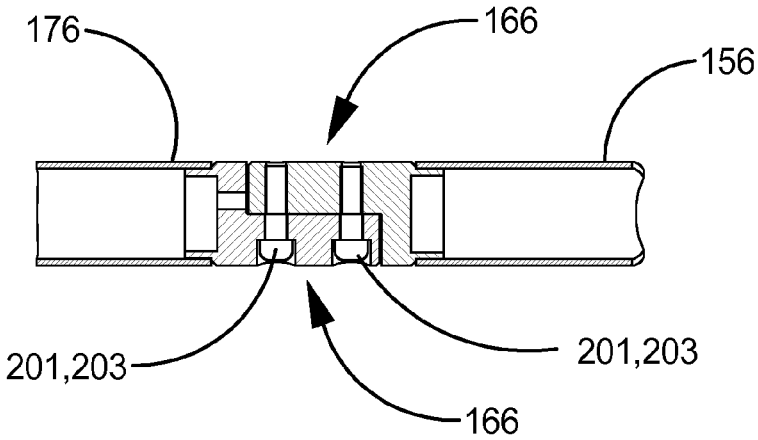
FIG. 5B is a frontal cross-sectional view of the exemplary joint of FIG. 5A between select members of an exemplary embodiment.

As illustrated in FIGS. 1-2 and as discussed above, rear legs 106, 108 also may be comprised of multiple sections or members. As illustrated in the embodiment of FIGS. 1-2, rear leg 106's lower section 156 may be connected to upper section 176 by way of joint 166 which is illustrated in FIGS. 5A-5B. FIG. 5A shows two bolts 201 which extend between the sections 176, 156 such that the two sections 156, 176 are connected and together comprise rear leg 106. FIG. 5B illustrates joint 166 when bolts 201 have been removed from slots 203 and the two sections 156, 176 may be separated such as when boat cover 100 is in a folded state as discussed in detail below.

Figure 6:
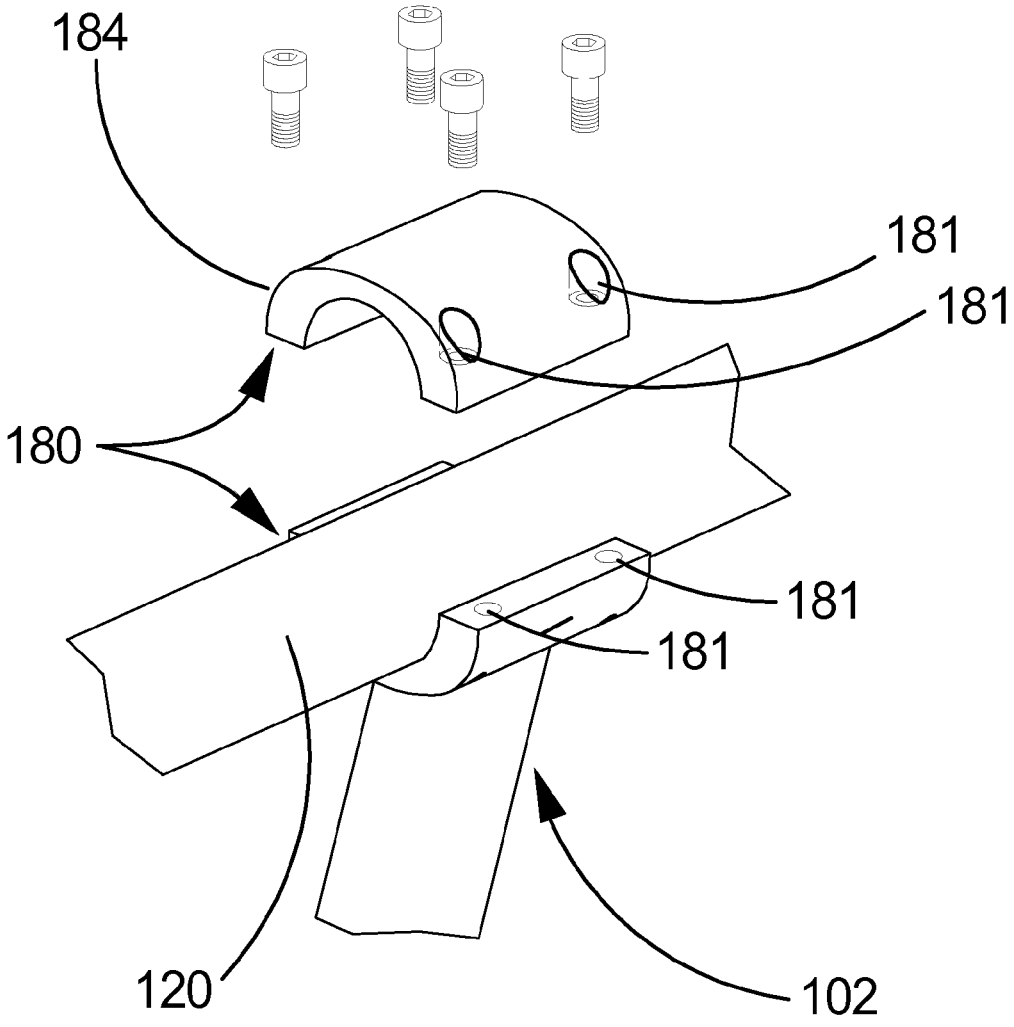
FIG. 6 is an enlarged exploded view of a clamshell-type clamp portion of the embodiment of FIGS. 1-2.

FIG. 6 illustrates a clamshell-type clamp or attachment means such as that illustrated in the exemplary embodiment shown in FIGS. 1-2 which shows clamps 180, 190, 200, 210. In the illustrated embodiment, proximal ends of legs 102, 104, 106, 108 are attached to cover portion 110. In the exemplary embodiment, clamshell-type clamps are positioned at proximal ends of each of legs 102, 104, 106, 108 such that the clamps secure the cover portion to the legs. It will be appreciated that in some embodiments, other attachment means may be utilized to attach the legs to the cover portion including, but not limited to, screwing, gluing, bonding, welding, various clamps, connecting plates, and hook and eye. FIG. 6 illustrates that the clamps may include a plurality of slots 181 for receiving bolts in order to secure the two halves 182, 184 of the clamps together while securely holding a portion of cover portion 110 between the halves.

In more detail, the illustrated embodiment of FIG. 5 shows leg 102 attached to cover portion 110 cross member 120 by way of a clamshell-type clamp 180. The bottom half 182 of clamshell-type clamp 180 may be attached to first leg 102 by welding or other means. In this exemplary embodiment, a corresponding upper half 184 of clamp 180 is secured to bottom half 182 with a plurality of screws or bolts such that clamp 180 is secured to both a leg and cover portion 110. It will be understood that other means are suitable for securing the legs, for example front legs 102, to cover portion 110. Similar clamps may be affixed to one or more of the remaining legs in order to secure the legs to cover portion 110.

In the exemplary embodiment shown in FIGS. 1-2, clamps 180, 190, 200, 210 secure respective legs 102, 104, 106, 108 to various cross-members of cover portion 110. In the illustrated embodiment, clamp 180 secures leg 102 to cross-member 120, clamp 190 secures leg 104 to cross member 120, clamp 200 secures leg 106 to cross member 122 and clamp 210 secures leg 108 to cross member 122. By using clamps 180, 190, 200, 210 to secure the various legs to various cross members, the clamps may be placed at various locations on the cross-members such that boat cover 100 may be placed onto variously sized and dimensioned boats (i.e., the space between clamps 180, 190 may be increased if the boat is wide and the space between them may be reduced if the boat is narrow). Further, and as will be known by those of skill in the art, both cover portion 110 and the base structure may be comprised of any number of cross members or braces in order to provide additional structural integrity or mounting points both as attachment points and in order to secure other apparatus to the cover portion or the base structure. Further, although illustrated with the various legs being secured to various cross members of cover portion 110, the legs may be attached to other parts of the cover portion including the outer perimeter as identified by front cover portion 112, side portions 114, 116 and rear portion 118.

The exemplary embodiment of FIGS. 1-2 also illustrate a plurality of optional braces and/or cross members including a lower cross brace 126 between front leg 102 and rear leg 106, a lower cross brace 128 between front leg 104 and rear leg 108, an upper cross brace 130 between front leg 102 and rear leg 106, and an upper cross brace 132 between front leg 104 and rear leg 108. Use of such braces can increase the structural integrity of boat cover 100 by way of the base structure in concert with cover portion 110. In other embodiments, such braces and cross members provide convenient locations for mounting other devices such as electronic navigational equipment, rod holders, speakers, etc. A further brace or braces may extend between front legs 102, 104 and/or rear legs 106, 108 in order to provide greater structural support for boat cover 100. In one embodiment, a brace may extend from front leg 102, through a center console of a boat and then to front leg 104. In such an arrangement, the center console is able to provide additional stabilization to boat cover 100.

B. Cover Portion

FIG. 7 illustrates the exemplary embodiment shown in FIGS. 1-2 in a partially folded or "not extended" state. FIGS. 1, 2 and 7 show cover portion 110 comprising a front cover portion 112, first side portion 114, second side portion 116 and rear portion 118. Cover portion 110 may comprise any number of cross members and the illustrated embodiment comprises cross member 120, cross member 122, and cross member 124. Each section also may be comprised of any number of subsections, for example, in an exemplary embodiment illustrated in FIG. 8A-8B and FIG. 9, cover portion 110's front cover portion 112 comprises first member 250 and second member 252, first side portion 114 comprises first member 254 and second member 256, second side portion 116 comprises first member 258 and second member 260, and rear portion 118 comprises first member 262 and second member 264. Similarly, cross member 120 comprises first member 266 and second member 268, cross member 122 comprises first member 270 and second member 272, and cross member 124 comprises first member 274 and second member 276.

Figures 8A, 8B:
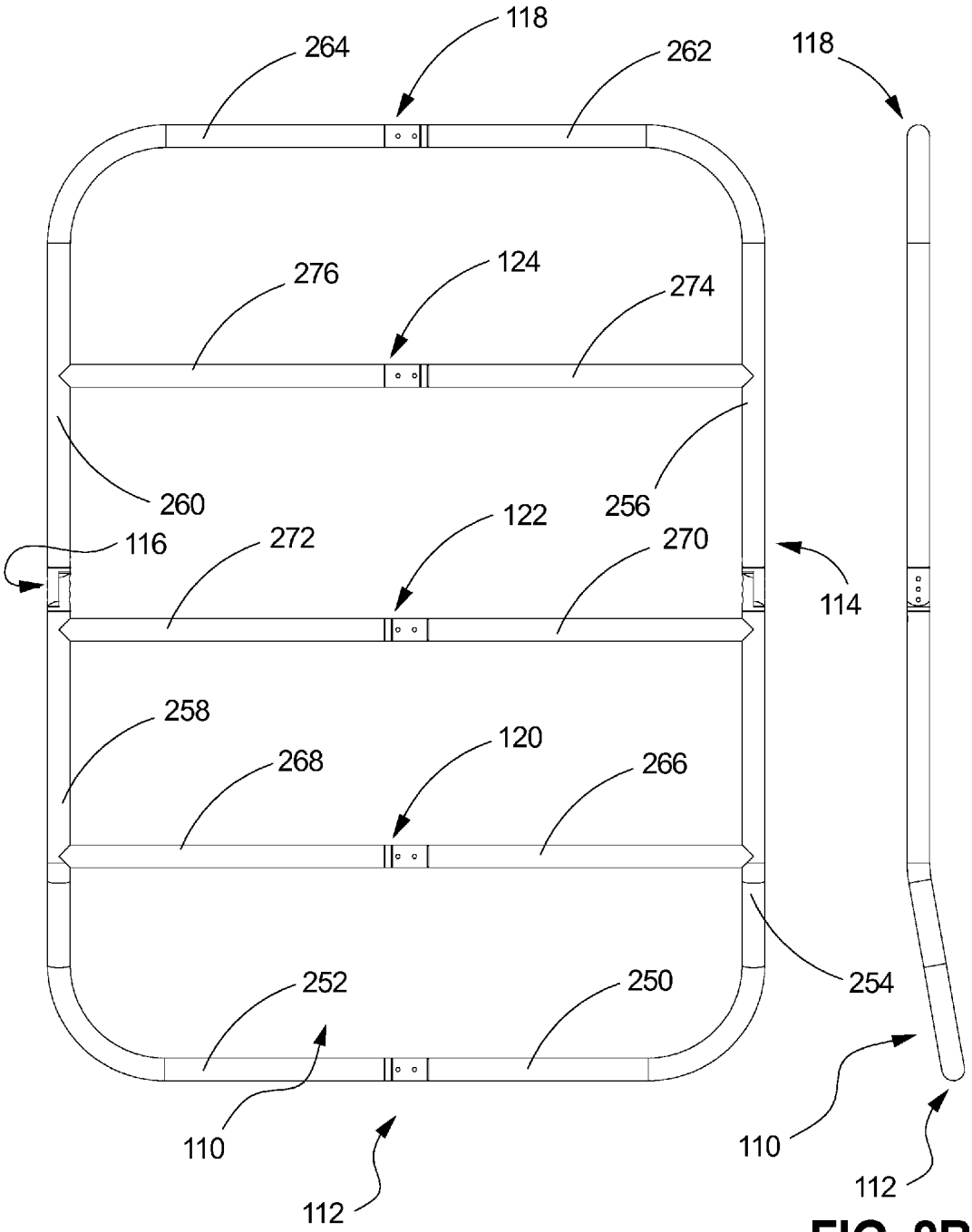
FIGS. 8A and 8B are side and top views, respectively, of the cover portion of the exemplary embodiment of FIGS. 1-2.
Figure 9:
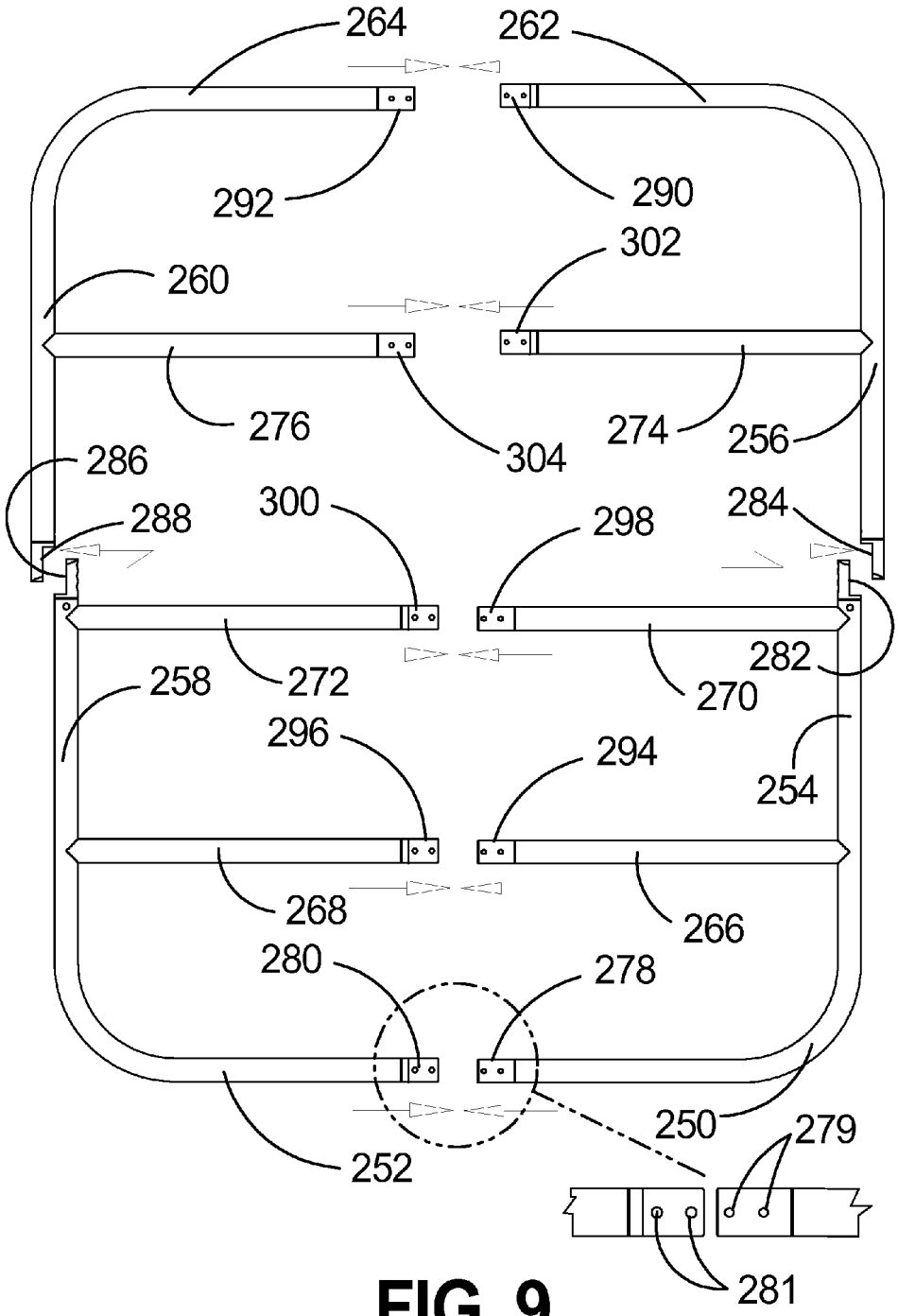
FIG. 9 is a top view of the cover portion of the embodiment of FIG. 8A-8B in a disassembled state.

FIG. 9 shows the embodiment of FIGS. 8A-8B wherein the various members and cross members are in a partially disassembled state such that cover portion 110 comprises four quadrants 328, 330, 332, 334. FIG. 9 also illustrates that front cover portion 112's first member 250 has an attachment end 278 that, in the illustrated embodiment, includes two slots 279. Similarly, front cover portion 112's second member 252 includes an attachment end 280 with two slots 281. In an exemplary embodiment, attachment end 278 may be connected to attachment end 280 by way of screws or bolts which extend through one of the sets of slots 279, 281 and is received by the other set of slots 281, 279. Thus, a user may assemble cover portion 110 by simply inserting some screws or bolts though one set of the slots and thus connect the two member of front cover portion 112 together. Similarly if the user wants to disassemble front cover portion 112, they can simply remove the bolts. The ability to break down front cover portion 112, and the other sections of cover portion 110, is particularly useful when shipping the components as they will fit into a smaller package than if cover portion 110 or front cover portion 112 were single unitary components. Though the means illustrated to connect the various members is illustrated as a plurality of slots and bolts or screws, numerous other methods may also be utilized including, but not limited to, screw connections, push-button connections, spring-biased connections, gluing, bonding, welding, and swaging one pipe/tube to a smaller diameter pipe/tube and then bolting, or otherwise attaching or coupling, adjoining pipes/tubes together. Further, in some embodiments, the various members may be permanently connected to other members. Such a permanent fixed configuration may be desirable if the user is not going to disassemble the various sections.

Similarly to front cover portion 112, first side portion 114, second side portion 116 and rear portion 118 may be comprised of multiple sections such as illustrated in FIG. 9 in which first side portion 114 comprises first member 254 with attachment end 282 and second member 256 with attachment end 284; second side portion 116 comprises first member 258 with attachment end 286 and second member 260 with attachment end 288; and rear portion 118 comprises first member 262 with attachment end 290 and second member 264 with attachment end 292.

The various cross members 120, 122, 124 may also be comprised of various members as illustrated in FIG. 9. FIG. 9 illustrates cross member 120 comprising first member 266 with attachment end 294 and second member 268 with attachment end 296; cross member 122 comprising first member 270 with attachment end 298 and second member 272 with attachment end 300; and cross member 124 comprising first member 274 with attachment end 302 and second member 276 with attachment end 304.

As discussed above, cover portion 110 also may comprise one or more hinges such that the cover portion can be folded as shown in various embodiments in various figures. FIGS. 2 and 7 illustrate two conditions in which cover portion 110 is in a folded or "not extended" position. In the exemplary embodiment of FIGS. 1-2 and 7, side portions 114, 116 each include a hinged connection between their first and second members, 254/256 and 258/260 respectively.

Figure 10A:
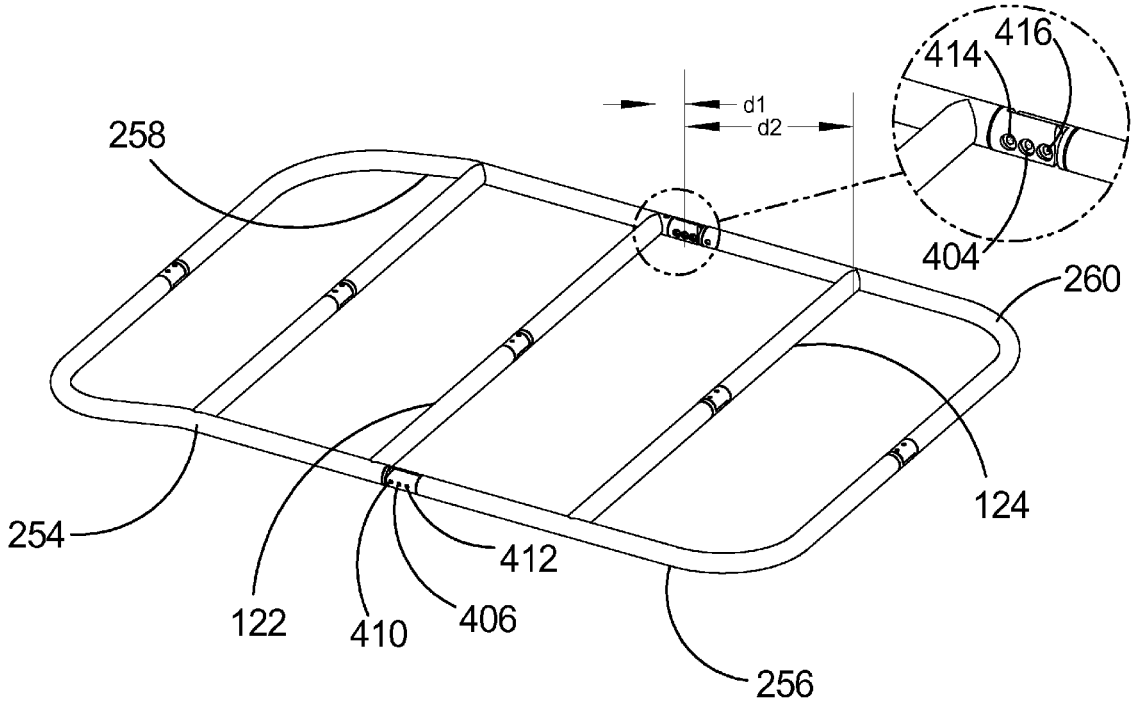
FIG. 10A is a perspective view of an exemplary cover portion of an exemplary embodiment.

FIGS. 10A-D illustrate various views of an exemplary cover portion of the present embodiment. FIG. 10A illustrates relationships between various cross-members 122, 124 and a hinge point/hinge bolt 404 such as a distance d1 between a first cross member 122 and hinge point/hinge bolt 404 (distance d1 is also the same distance as between hinge point/hinge bolt 406 and cross member 122) and a distance d2 between a second cross member 124 and hinge point/hinge bolt 404 (distance d2 is also the same distance as between hinge point/hinge bolt 406 and cross member 124). In this exemplary embodiment, hinge point/hinge bolt 404 connects second side portion 116's first member 258 and second member 260 and hinge point/hinge bolt 406 connects first side portion 114's first member 254 and second member 256.

The exemplary embodiment illustrates hinge point/hinge s 404, 406 as connecting the various members, although numerous other means may be utilized to hingedly connect the various members. Further, the various members may be removably connected such that they may be completely disconnected from each other in order to fold or collapse the cover portion such as if the hinge bolts were completely removed.

Note that although the exemplary cover portion illustrated in FIGS. 10A-D has three cross members and two hinge points, any number of cross members, or even none at all, may be present in accordance with the various embodiments. Further, any number of hinge points may be present, i.e., two as shown, or even more or less. In an exemplary embodiment with no cross members, the hinge point/hinge bolts are positioned the distance d1 from one end of the cover portion and the distance d2 from an opposite end of the cover portion.

Figure 10B:
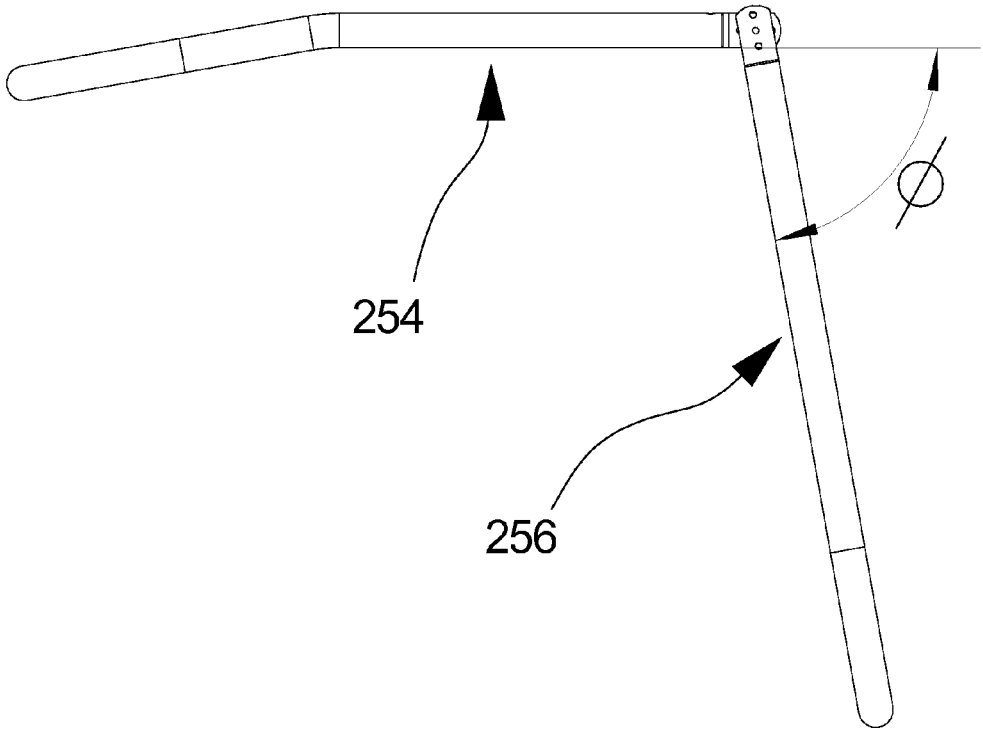
FIG. 10B is a side view of an exemplary hinge portion of the exemplary cover portion of FIG. 10A in a partially folded state.

In the exemplary embodiment shown in FIGS. 10A-D, in addition to hinge bolt 406, two support bolts 410, 412 may be utilized to maintain the cover portion in the condition illustrated in FIG. 10A, i.e., the "extended" position/state. Hinge bolt 404 may similarly be supported by one or more bolts 414, 416. FIG. 10B illustrates a condition in which bolts 410, 412 have been at least partially removed from slots 411, 413 in second member 256 such that the various members are no longer in a locked state and the cover portion may be folded as illustrated. An angle Φ is be defined as the angle by which the cover portion has been folded as illustrated in FIG. 10B. Angle Φ may range from approximately 0° to about 10° when rear portion 118 is pivoted downward as illustrated, or rear portion 118 may be pivoted upward such that angle Φ may range from 0° to about −110°. In other embodiments, angle Φ may range from approximately −180° to 180° depending on the geometry of the boat cover and the configuration of the boat.

Figure 10C:
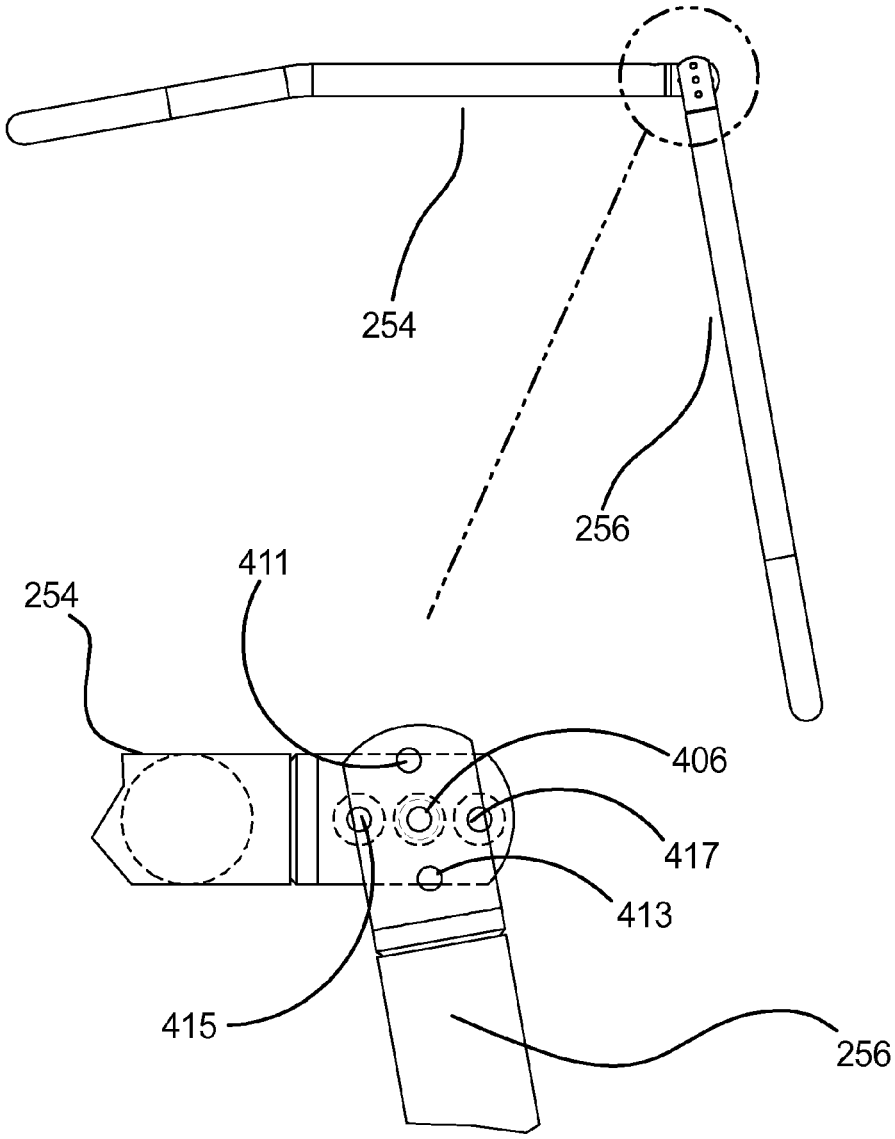
FIG. 10C is a partial sectional frontal view of the exemplary hinge portion of FIG. 10B.
Figure 10D:
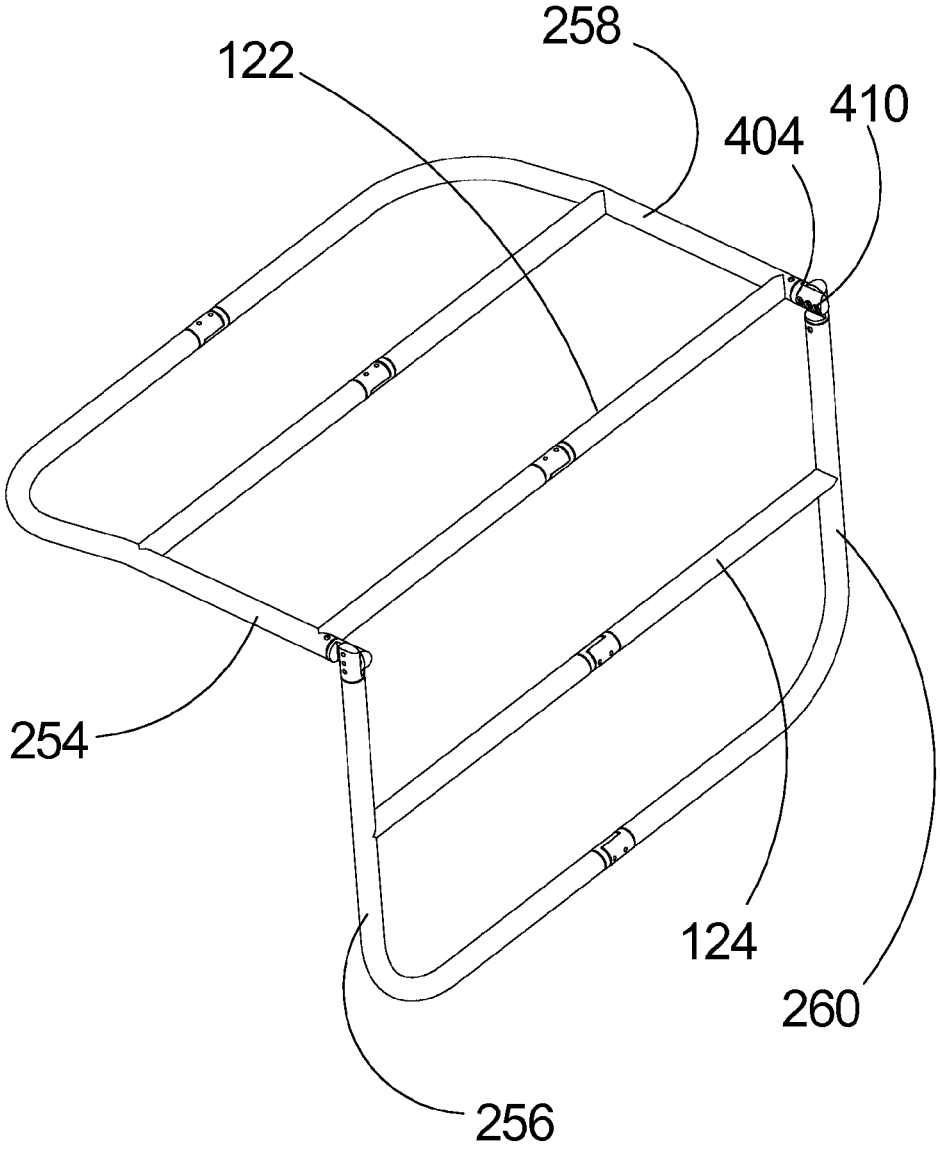
FIG. 10D is a perspective view of the exemplary cover portion of FIGS. 10A-C in a partially folded state.

FIG. 10C illustrates the exemplary hinge portion of the exemplary cover portion of FIGS. 10A-B between first member 254 and second member 256. In this exemplary embodiment, the relationship between slots 411, 413 in second member 256 can be seen relative to slots 415, 417 in first member 254 when second member 256 is pivoted relative to first member 254 about hinge point 406.

In the exemplary embodiment, three bolts 406, 410, 412 are used to provide extra strength as various equipment such as electronic equipment and fishing gear may be attached to the fore or aft portions of cover portion 110 though this number of bolts may be increased or decreased in a given embodiment. It will be recognized that various other connections are possible for the various embodiments including various types of hinges and connections. Further, rather than being hingedly connected, it is desirable in some embodiments to be able to completely separate the first and second members such as for disassembling boat cover 100 for storage or for shipping purposes. In various exemplary embodiments, cover portion 110 may be in a position other than the "extended" position as shown in FIG. 1. As mentioned above, such a "not extended" position may be as illustrated, for example, in FIGS. 2, 7, and 10D, or, in an alternative embodiment, the cover portion may be in a not extended position by breaking down the cover portion into two or more pieces (such as, for example, as illustrated in FIG. 9). In another exemplary embodiment (not shown), cover portion may be in a not extended position by telescoping one or more segments or members of the cover portion relative to other segments or members (i.e., telescoping a rear portion of the cover portion toward or away from a front cover portion, or a side portion of the cover portion toward/away from a second side portion of the cover portion).

Various embodiments of the boat covers also may include a screen 310 as shown in FIG. 7. Screen 310 may provide a layer to block sun or rain or fulfill other purposes such as presenting a surface on which to place advertising or a surface for mounting various devices such as electronics. Screen 310 may be attached to cover portion 110 in a variety of manners including, but not limited to, elastic cords, rope, hook and loop (i.e., Velcro ®), snaps, and zippers. In the embodiment shown in FIG. 7, rope 314 is threaded through a plurality of eyelets 316 in screen 310 and around various members of cover portion 110.

In some embodiments and as discussed above, the various cross members of cover portion 110 (or in the case that there are no cross members, from the ends of the cover portion) may be configured such that cover portion 110 may be folded or otherwise transformed from an extended position to a not extended position without causing any additional tension to screen 310. In the illustrated embodiment of FIGS. 1-2, for example, cross members 122, 124 are spaced a sufficient distance from each other and the two hinge points 404, 406 that when cover portion 110 is folded as in FIGS. 2 and 7, screen 310 is not under any additional tension than when cover portion 110 is in the extended position of FIG. 1.

In one exemplary embodiment distance d1 is approximately equal to distance d2. In another exemplary embodiment, d1 is approximately equal to one-half of distance d2. In another exemplary embodiment d1 and d2 are each at least 0.5 times an outer diameter of the nearest cross member (or end member if it is closer to the hinge or if there are no cross members). In another exemplary embodiment, distances d1 and d2 are each at least 1.0 times an outer diameter of the nearest cross member. In another exemplary embodiment, distances d1 and d2 are each at least 2.0 times an outer diameter of the nearest cross member. Note that for the preceding embodiments, that if there are no cross members, then the distances are taken to be the distance from an inside edge of the end of the cover portion as discussed above.

C. Materials

The boat cover embodiments described herein may be constructed from various materials. In one exemplary embodiment, hardened aluminum, such as the 6000 series and in particular grades 6061 or 6063 is used for constructing the base structure including the front legs, rear legs, various braces and cross members, base members and clamps as well as the cover portion. Where aluminum is chosen, if the boat cover will be given a polished finish, then 6063 grade is used. The aluminum is heat treated (e.g., from a T5 to a T6 temper). In another embodiment stainless steel may be used for the base structure and/or cover portion. The cover portion, legs and any cross-members or braces may be prepared by milling, then cutting, bending, and welding as necessary, then heat treating, and finishing by powder coating, by anodizing and polishing, or by other similar techniques common in marine use.

The optional screen may be comprised of any suitable material including, but not limited to, cloth, nylon, canvas, tarpaulin, and plastics. In one exemplary embodiment, the screen is comprised of a malleable and resilient material such that it is able to be folded many times such as would occur if the cover portion is folded on a regular basis. In other exemplary embodiments, the screen is comprised of a material which is resistant to stains including molds an mildew and is otherwise able to stand up to environmental conditions without deteriorating. In yet another exemplary embodiment, the screen comprises Sunbrella® fabric available from Glen Raven, Inc.

II. Methods of Folding Boat Covers

Figure 11A:
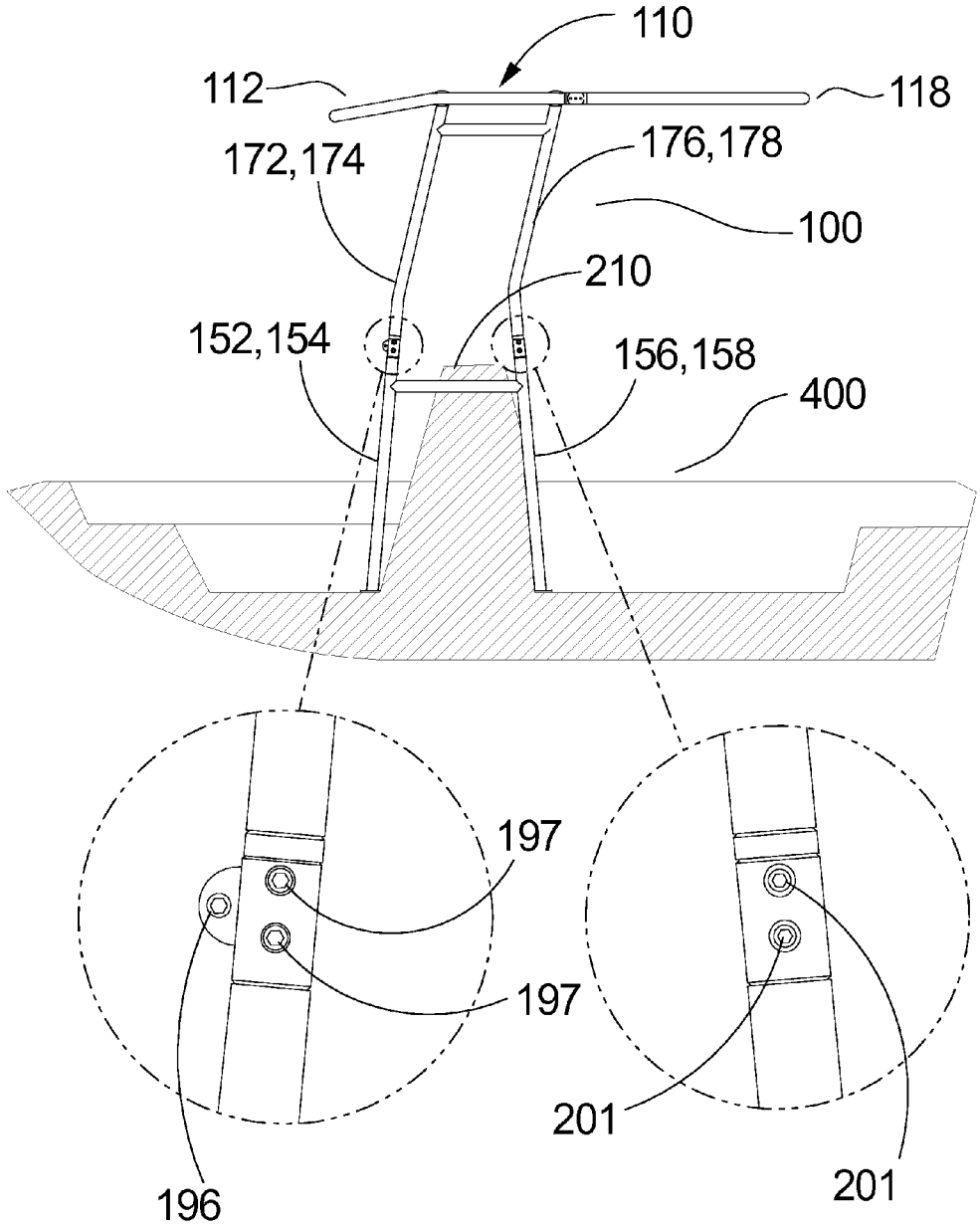
FIG. 11A is a side view showing an exemplary cover mounted to a boat and in an upright state.
Figure 11B:
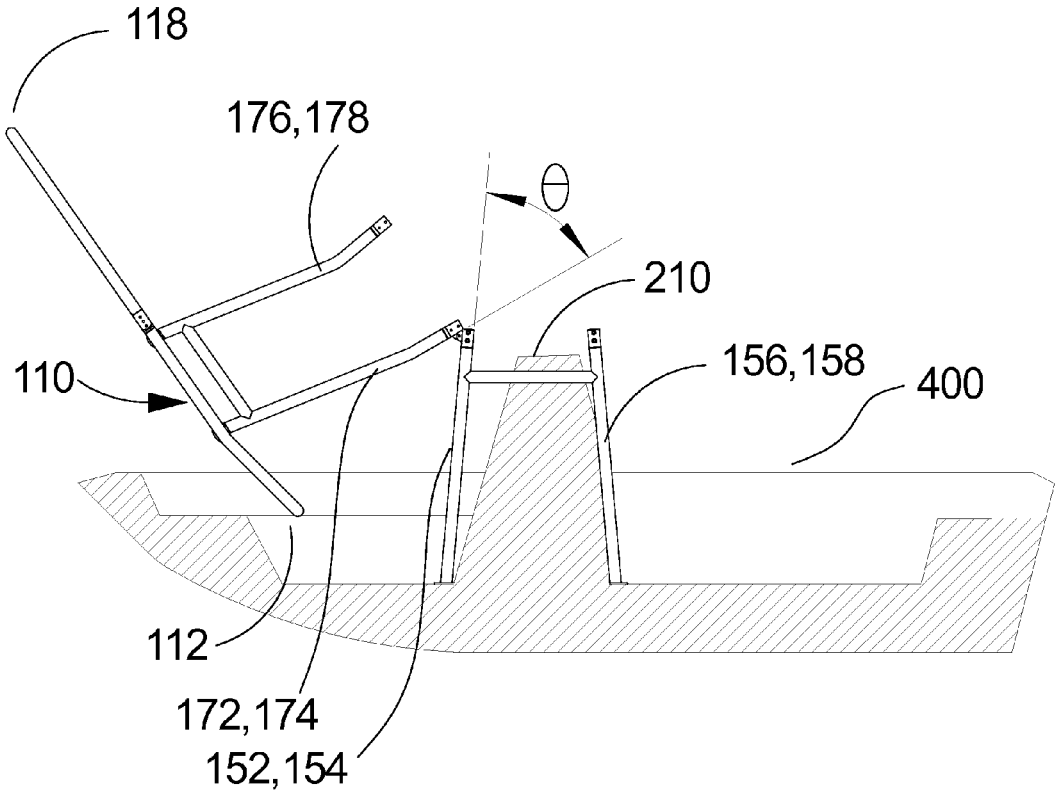
FIG. 11B is a side view showing the exemplary cover mounted to a boat and in a partially folded state.
Figure 11C:
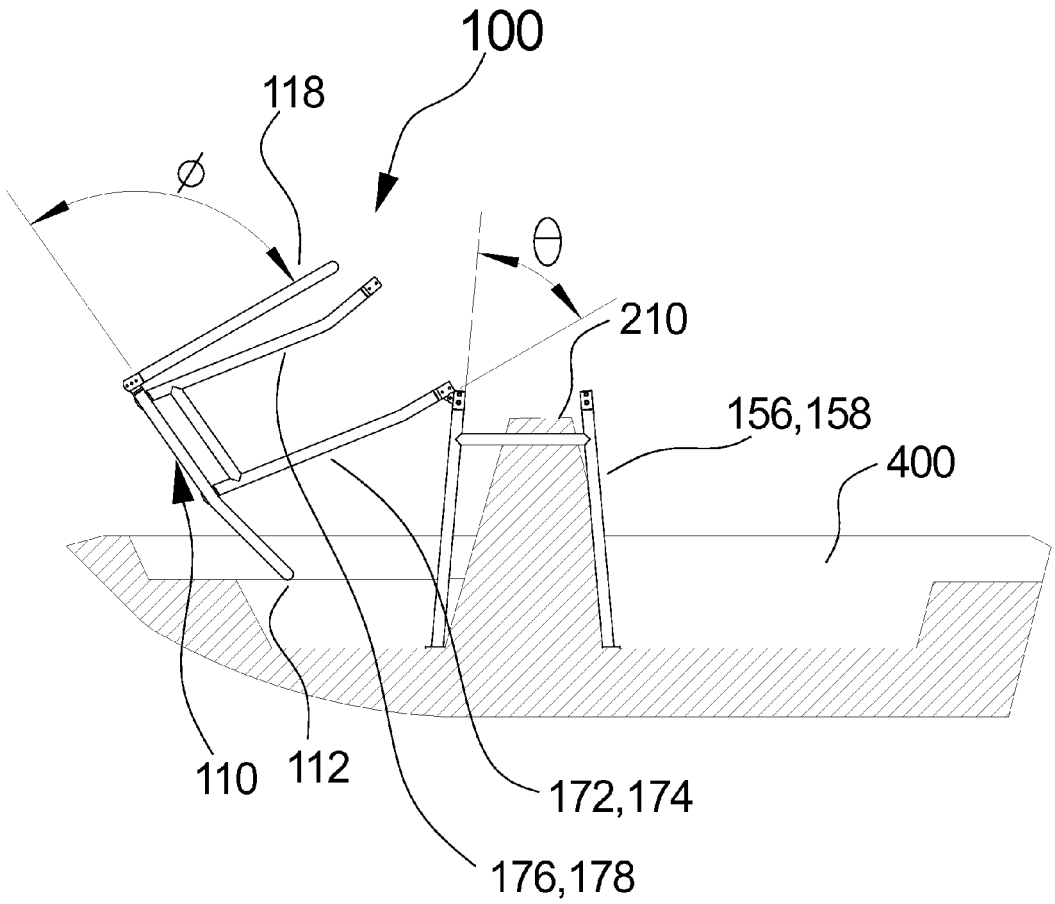
FIG. 11C is a side view showing the exemplary cover mounted to a boat and in a completely folded state.

When using certain boat cover embodiments such as the boat cover 100, there may be a need to fold it down from time to time when it is not in use or to go under bridges and other overhead obstructions. Specifically, when placing a boat canvas or tarpaulin over the boat, when towing the boat or placing the boat onto an overhead lift, one may desire to fold down the boat cover 100. In FIGS. 1, 11A, and 14, the boat cover 100 is in the fully upright position as when on a boat structure 400 of FIG. 11A. Upon the user deciding to fold down the boat cover 100, the user can (1) remove the one or more bolts from rear legs 106, 108 (see, for example, FIGS. 5A-5B) such that the upper and lower sections of the rear legs are no longer affixed to each other, (2) remove the one or more bolts from front legs 102, 104 which prevent upper sections 172, 174 from pivoting relative to respective lower sections 152, 154 (see, for example, FIGS. 2 and 4), (3) pivot upper sections 172, 174 of the front legs relative to lower sections 152, 154 which will also cause cover portion 110 to be pivoted as it is attached to the legs (see, for example, FIG. 2 and FIG. 11B where the amount of pivot is shown as angle θ), (4) remove the one or more bolts from cover portion 110 such that the rear portion 118 of cover portion 110 can pivot relative to front cover portion 112 of cover portion 110 (see, for example, FIGS. 10B-10C), and (5) pivot cover portion 110 to a desired position (see, for example, FIG. 10D and 11C).

In accordance with steps (1)-(5), the boat cover may be converted from the upright extended condition of FIG. 1 to the reclined/not extended position shown in FIG. 2 such that a boat canvas or boat lift may be used. Note that it may be desirable when folding down the boat cover 100 in this manner to utilize some padding such as a life vest between the points of contact of the cover portion and each of the legs to preserve the finish of both the boat cover 100 and the boat.

III. Methods of Packaging Boat Covers

Figure 12:
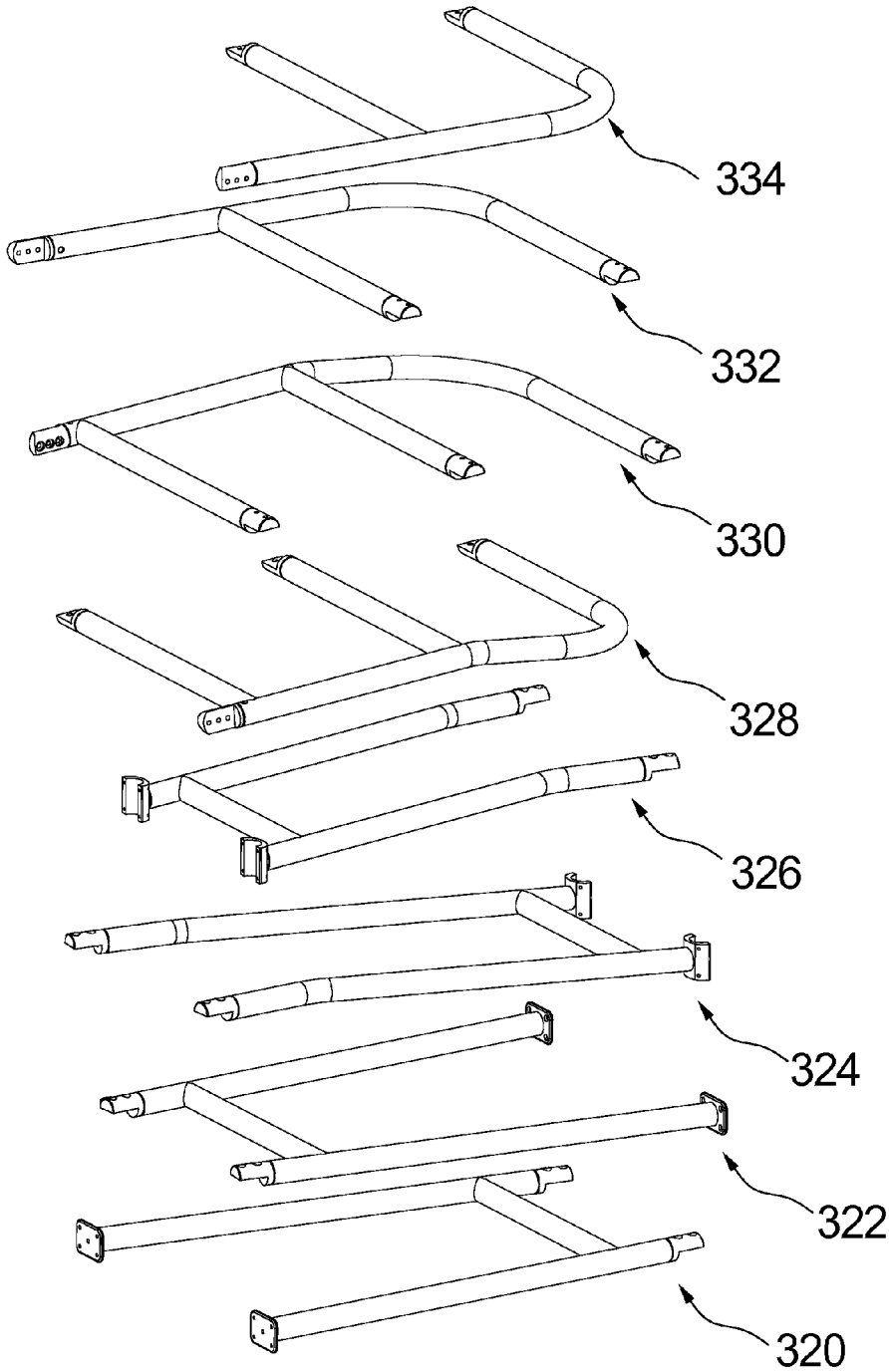
FIG. 12 is a perspective view of an arrangement of various members of an exemplary boat cover according to the embodiment.

In addition to folding down into a manageable configuration, boat cover 100 may also be packaged in a disassembled state to be transported. As shown in FIGS. 11 and 12, this disassembled boat cover embodiment 100' may be packaged in a relatively small container 250. FIG. 13 illustrates an arrangement of four quadrants 328, 330, 332, 334 of cover portion 110 and leg subassemblies 320, 322, 324, 326. FIG. 13 illustrates a stacking order of the various components illustrated in FIG. 12.

The boat cover embodiment 100 described above includes many features. However, various embodiments of the boat cover may include one or more of these features while omitting others. Accordingly, it will be appreciated that these various features discussed above with reference to FIGS. 1-12 may be present alone or in combination, depending upon the particular needs being addressed by the boat cover embodiment being constructed.

While illustrative embodiments have been particularly shown and described, it will be understood by those skilled in the art that various other changes in the form and details may be made therein without departing from the spirit and scope of the invention.

What is claimed is:

1. A boat cover, comprising:

a cover portion including a plurality of spaced leg attachment points, the cover portion providing a framework upon which a continuous screen is attached in an outstretched orientation over the framework such that the continuous screen spans the space between the plurality of leg attachment points, the framework including a first portion interconnected to a second portion and where the continuous screen spans over the first and second portions; and a base structure, said base structure including:

a first leg including a distal end and a proximal end, said distal end providing a boat attachment point and said proximal end providing a cover attachment point;

a second leg including a distal end and a proximal end, said distal end providing a boat attachment point and said proximal end providing a cover attachment point;

a third leg including a distal end and a proximal end, said third leg linked to said cover portion;

a fourth leg including a distal end and a proximal end, said fourth leg linked to said cover portion; and wherein said cover portion has a first position in which said cover portion is extended so that the first and second portions of the framework lie within a first plane and a second position in which the cover portion is not extended so that the first portion lies within the first plane and the second portion lies within a second plane that is different than the first plane and wherein the continuous screen remains in the outstretched orientation over the framework and continues to span the space between the leg attachment points in both the first position and the second position.

2. The boat cover of claim 1, wherein said first leg and said second leg each include a hinge point between said distal and proximal ends such that said first leg is comprised of an upper section and a lower section and said second leg is comprised of an upper section and a lower section.

3. The boat cover of claim 1, further comprising at least one cross brace between said first and third legs and between said second and fourth legs.

4. The boat cover of claim 1, wherein each leg and the cover portion are aluminum.

5. The boat cover of claim 1, wherein said fourth and said third legs are each comprised of a lower section and an upper section wherein said upper section can be removably attached to said lower section.

6. The boat cover of claim 1, wherein said cover portion further comprises at least one hinge such that said cover portion is transformed from said extended position to said not extended position by pivoting the first portion of the cover portion about said at least one hinge relative to the second portion of the cover portion.

7. The boat cover of claim 6, wherein the cover portion includes a first cross-member running parallel to an axis of the at least one hinge and being between the at least one hinge and an outer member of the cover portion, wherein the cover portion further includes a second cross-member running parallel to the axis of the at least one hinge and being between the at least one hinge and a second outer member of the cover portion, and wherein the continuous screen that is attached to said cover portion is outstretched over the first and second cross-members in both the first and second positions.

8. A boat cover, comprising:

a cover portion which includes at least one hinge such that said cover portion has at least two positions, an extended position and a folded position, wherein the cover portion includes a first cross-member running parallel to an axis of the at least one hinge and being between the at least one hinge and an outer member of the cover portion and wherein the cover portion further includes a second cross-member running parallel to the axis of the at least one hinge and being between the at least one hinge and a second outer member of the cover portion that is located on an opposite side of the at least one hinge from the first outer member, the cover portion further including a continuous screen spanning over both the first cross-member and the second cross-member; and a plurality of legs at least one of which supports said cover portion.

9. The boat cover of claim 8, wherein the plurality of legs comprises:

a first leg including an end providing a boat attachment point and a cover attachment point;

a second leg including an end providing a boat attachment point and a cover attachment point;

a third leg including an end providing a boat attachment point and a cover attachment point; and a fourth leg including an end providing a boat attachment point and a cover attachment point.

10. The boat cover of claim 9, wherein said first leg includes a hinge and said second leg includes a hinge, and wherein a proximal end of said first leg can be pivoted relative to a distal end of said first leg and a proximal end of said second leg can be pivoted relative to a distal end of said second leg.

11. The boat cover of claim 9, further comprising at least one cross member between opposite sides of said cover portion and wherein at least one of said first leg, said second leg, said third leg, or said fourth leg is attached to said cover portion at said cross member.

12. The boat cover of claim 8, wherein at least one of said plurality of legs is comprised of aluminum.

13. The boat cover of claim 8, wherein at least one of said plurality of legs is curved.

14. The boat cover of claim 8, wherein at least one of said plurality of legs is bent.

15. The boat cover of claim 8, further comprising at least one cross brace between two of said plurality of legs.

16. The boat cover of claim 8, wherein the at least one leg that supports the cover portion includes a hinge and wherein an axis of the at least one hinge of the cover portion is parallel to an axis of the hinge of the at least one leg.

17. A method of configuring a boat cover that has at least one leg and a cover portion such that the boat cover is mounted to a boat by the at least one leg supporting the cover portion above the boat, said method comprising:

providing a screen having multiple individual points of attachment to the cover portion;

pivoting a first portion of said cover portion relative to a second portion of said cover portion while maintaining the multiple individual points of attachment of the screen to both the first portion and the second portion of the cover portion;

rotating said cover portion relative to at least a portion of said at least one leg, wherein the rotation of the cover portion relative to at least the portion of the at least one leg occurs about an axis that is parallel to an axis of the pivoting of the first portion of the cover portion relative to the second portion of the cover portion, wherein said at least one leg comprises at least one front leg and at least one rear leg, and wherein said at least one front leg includes an upper section and a lower section connected by a hinge and said rear leg includes an upper section which is removably connected to a lower section;

disconnecting said upper section of said at least one rear leg from said lower section of said at least one rear leg, and wherein said rotating step comprises rotating said cover portion and said upper section of said at least one front leg relative to said lower section of said at least one front leg.

18. A method of packaging components of a boat cover comprising a plurality of legs and a cover portion, the method comprising:

positioning the plurality of legs one on top of another in a stacked configuration, the plurality of legs including a lower first leg portion and a lower third leg portion connected by a first cross brace, a lower second leg portion and a lower fourth leg portion connected by a second cross brace, an upper first leg portion and an upper third leg portion connected by a third cross brace, an upper second leg portion and an upper fourth leg portion connected by a fourth cross brace where positioning of the plurality of legs places the first and second cross braces at opposite sides of the stacked configuration and places the third and fourth cross braces at opposite sides of the stacked configuration, and positioning four quadrants of the cover portion on top of one another in a stacked configuration such that the stacked configuration of the four quadrants is stacked with the stacked configuration of the plurality of legs, the four quadrants including a first quadrant with a first cross member portion, a second quadrant with a second cross member portion that is a mate to the first cross member portion, a third quadrant with a third cross member portion, and a fourth quadrant with a fourth cross member portion that is a mate to the third cross member portion.

* * * * *